US010158180B1

(12) United States Patent
Riley et al.

(10) Patent No.: US 10,158,180 B1
(45) Date of Patent: Dec. 18, 2018

(54) ULTRAWIDEBAND NESTED BOWTIE ARRAY

(71) Applicant: NORTHROP GRUMMAN SYSTEMS CORPORATION, Falls Church, VA (US)

(72) Inventors: Norma W. Riley, Cedar Crest, NM (US); Douglas J. Riley, Cedar Crest, NM (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 183 days.

(21) Appl. No.: 15/216,468

(22) Filed: Jul. 21, 2016

Related U.S. Application Data

(60) Provisional application No. 62/201,253, filed on Aug. 5, 2015.

(51) Int. Cl.
*H01Q 9/28* (2006.01)
*H01Q 21/06* (2006.01)
*H01Q 1/48* (2006.01)

(52) U.S. Cl.
CPC ..... *H01Q 21/062* (2013.01); *H01Q 1/48* (2013.01)

(58) Field of Classification Search
None
See application file for complete search history.

(56) References Cited

U.S. PATENT DOCUMENTS 5,774,094 A 6/1998 Yonezaki
5,926,150 A 7/1999 McLean et al.
6,300,906 B1 * 10/2001 Rawnick ..... H01Q 1/38 343/700 MS
6,323,809 B1 11/2001 Maloney et al.
7,034,753 B1 * 4/2006 Elsallal ..... H01Q 21/0006 343/700 MS
7,310,065 B2 12/2007 Anguera Pros et al.
7,372,409 B2 5/2008 Morton
7,372,424 B2 5/2008 Mohuchy et al.
8,395,552 B2 3/2013 Geiler et al.
8,405,564 B2 3/2013 Kindt et al.
8,451,189 B1 5/2013 Fluhler
8,462,071 B1 * 6/2013 Rudish ..... H01Q 1/523 343/797
8,674,897 B2 3/2014 Schneider et al.
8,717,245 B1 5/2014 Krivokapic et al.
8,884,834 B1 11/2014 Paschen
8,934,021 B2 1/2015 Eden
(Continued)

OTHER PUBLICATIONS

Sayidmarie, Khalil H. "A Planar Self-Complementary Bow-Tie Antenna for UWB Applications" Progress in Electromagnetics Research C, vol. 35, 2013, pp. 253-267.
(Continued)

*Primary Examiner* — Trinh Dinh
(74) *Attorney, Agent, or Firm* — John A. Miller; Shumaker, Loop & Kendrick, LLP

(57) ABSTRACT

A wideband phased array including a plurality of nested sub-arrays each having a plurality of bowtie radiators and having a common aperture, where each sub-array covers a different frequency band. In one embodiment, a square high-band sub-array is positioned at a center of the phase array, a square mid-band sub-array surrounds the high-band sub-array, and low-band sub-array surrounds the mid-band sub-array.

18 Claims, 3 Drawing Sheets

(56) References Cited

U.S. PATENT DOCUMENTS

| | | | | |
|---|---|---|---|---|
| 9,048,546 | B2 * | 6/2015 | Tatarnikov | H01Q 15/0013 |
| 9,806,410 | B2 * | 10/2017 | Tatarnikov | H01Q 15/0013 |
| 2002/0140616 | A1 * | 10/2002 | Kanamaluru, Sr. | H01Q 25/00 343/756 |
| 2005/0200529 | A1 * | 9/2005 | Watanabe | H01Q 3/446 343/700 MS |
| 2007/0188395 | A1 * | 8/2007 | Liu | H01Q 19/17 343/779 |
| 2014/0176385 | A1 | 6/2014 | Apostolos et al. | |

OTHER PUBLICATIONS

Durgun, Ahmet C. "Flexible Bow-Tie Antennas with Reduced Metallization" Radio and Wireless Symposium, IEEE, 2011, pp. 50-53.

Kasemodel, Justin A. "Realization of A Planar Low-Profile Broadband Phased Array Antenna" Dissertation, The Ohio State University, 2010, 102 pgs.

* cited by examiner

ULTRAWIDEBAND NESTED BOWTIE ARRAY

CROSS-REFERENCE TO RELATED APPLICATIONS

This application claims the benefit of the priority date of U.S. Provisional Patent Application Ser. No. 62/201,253, titled, Ultrawideband Nested Bowtie Array, filed Aug. 5, 2015.

BACKGROUND

Field

This invention relates generally to a wideband phased array and, more particularly, to a wideband phased array that includes a plurality of nested sub-arrays each including a plurality of bowtie radiators, where each sub-array covers a different frequency band and where the plurality of sub-arrays have a common aperture.

Discussion

Phased array antennas are well known in the art for many communications applications. A typical phased array antenna will include many antenna radiating elements, such as 400 elements. The phase of each of the signals from a particular source received by the antenna elements are selectively controlled so that all of the signals are in phase with each at a common antenna port, which allows the antenna to be narrowly directed to the source with high gain. Phased array antennas are typically complex structures. For example, phased array antennas often include beam-forming networks that weight the individual signals so as to adjust their amplitude and phase so that they can be coherently added together in this manner. At relatively high frequencies, such as 60 GHz and above, state-of-the-art photolithography processes and mechanical tolerances cause limitations in hardware implementation. Often times, received signals are down-converted to an intermediate frequency requiring additional hardware with increased cost.

In order to provide wideband communications applications for a phased array antenna, such as 100 MHz-20 GHz, it is typically necessary to provide multiple phased array antennas that are separately driven and each have their own aperture, where each phased array antenna covers a portion of the total frequency band desired. Such wideband applications are thus complex, costly and require a relatively large amount of space.

DETAILED DESCRIPTION OF THE EMBODIMENTS

The following discussion of the embodiments of the invention directed to a wideband phased array including a plurality of nested sub-arrays each including a plurality of bowtie radiators is merely exemplary in nature, and is in no way intended to limit the invention or its applications or uses.

The present invention proposes a wideband phased array that has many applications for receiving and transmitting signals in multiple frequency bands. The phased array includes a plurality of nested sub-arrays each including a plurality of bowtie radiators and having a common aperture, where each sub-array operates at a particular frequency band and each bowtie radiating element in the group has a particular size for that frequency band. The discussion below will specifically describe various and many frequency bands, layer thicknesses, dielectric materials, radiating element sizes, etc. However, it will be understood that all of these specific values are by way of a non-limiting embodiment in that other values and materials may be applicable for other applications within the scope of the present invention.

Figure 1:
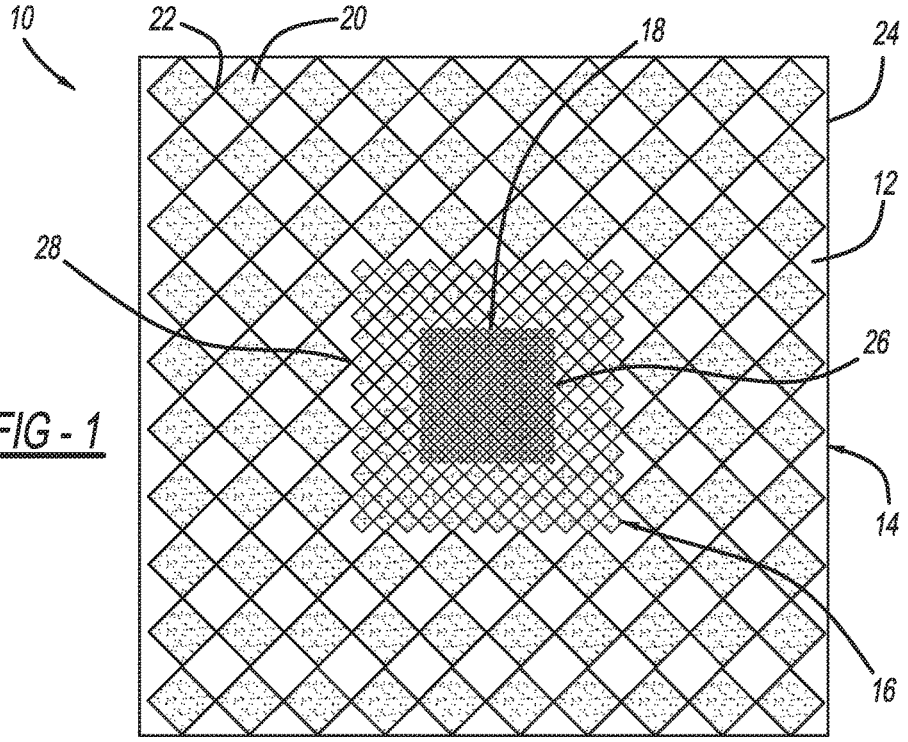
FIG. 1 is a top view of a wideband phased array including a plurality of nested sub-arrays each including a plurality of bowtie radiators, where each sub-array covers a particular frequency band.

FIG. 1 is a top view of an ultra-wideband phased array 10 including a thin substrate 12, such as a Teflon substrate, where top dielectric layers described below have been removed from the array 10 for clarity purposes. The phased array 10 includes a low-band sub-array 14, a mid-band sub-array 16 and a high-band sub-array 18 that are nested within a common aperture 24. Each of the sub-arrays 14, 16 and 18 includes a plurality of square radiating elements 20, where the points of the radiating elements 20 are electrically coupled to the points of adjacent radiating elements 20 so as to form a checker-board pattern, as shown. The radiating elements 20 can be printed on the substrate 12 using any suitable photolithography or other printing process for conductive elements.

As will be discussed in further detail below, each radiating element 20 is fed by a suitable electrical feed, such as a dual-polarized balun, beam-forming network, coaxial cable, etc. Each half section of two electrically coupled radiating elements 20 are electrically fed at a feed point 22, where the combined half sections define a bowtie radiator. In this specific design, the radiating elements 20 of one sub-array that is adjacent to an adjacent sub-array are also electrically coupled, for example, at points 26 and 28. When one of the particular sub-arrays 14-18 is operational, then the feeds for all of the radiating elements in the other two sub-arrays are electrically coupled to a load (not shown). In this manner, a common phased array having a single aperture can be provided for operation over a very wide frequency band by nesting the sub-arrays 14-18 as described.

Figure 2:
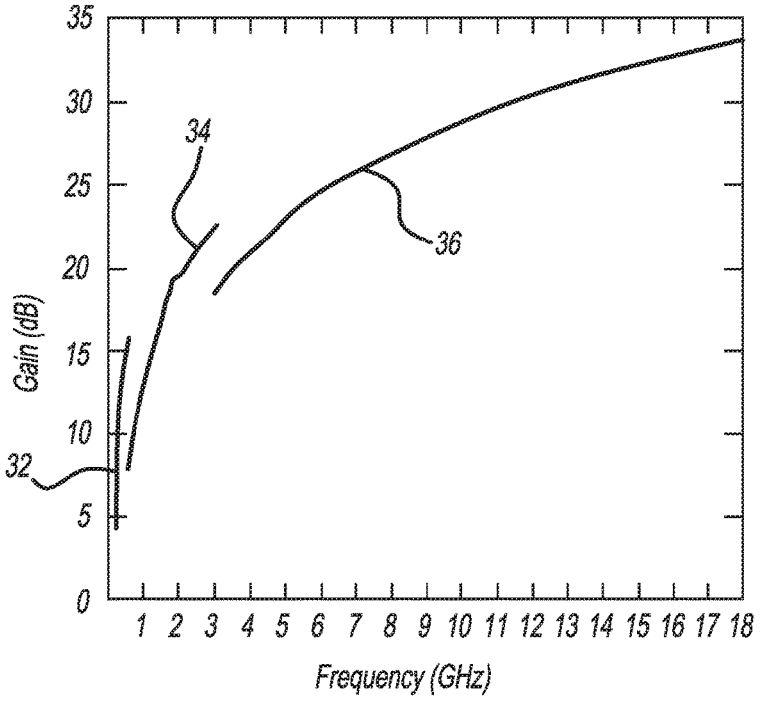
FIG. 2 is a graph with frequency on the horizontal axis and gain on the vertical axis showing the frequency band for each of the nested groups of radiating elements in FIG. 1.

FIG. 2 is a graph with frequency on the horizontal axis and gain on the vertical axis showing representative frequency bands for the sub-arrays 14-18. In this non-limiting embodiment, the low-band sub-array 14 operates in the 100-500 MHz frequency band represented by graph line 32, the mid-band sub-array 16 operates in the 500 MHz-3 GHz frequency band represented by graph line 34, and the high-band sub-array 18 operates in the 3-18 GHz frequency band represented by graph line 36. The representative gain varies depending on the size of the sub-array.

A ground plane is spaced from the radiating elements 20 to provide a resonate cavity, where the resonation of the signal of the particular frequency band is controlled by the dielectric constant of the material between the radiating elements 20 and the ground plane, which can be air. In order to decrease the height of the resonate cavity and optimize the performance of the array, various dielectric material layers can be provided in the resonant cavity for the particular frequency band.

Figure 3:
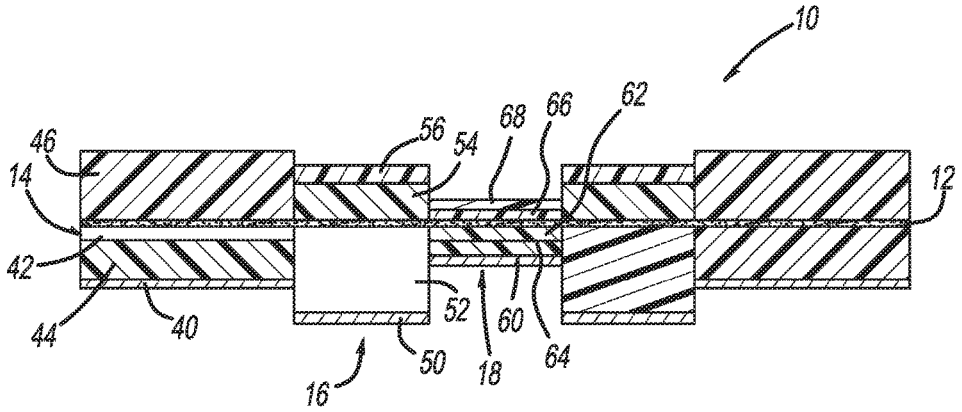
FIG. 3 is a cross-sectional view of the phased array shown in FIG. 1.

FIG. 3 is a cross-sectional view of the phased array 10 illustrating the various and several dielectric layers that are provided above and below the substrate 12 for each of the sub-arrays 14, 16 and 18. The various dielectric layers are by way of a non-limiting example and can be deposited and configured using any suitable fabrication process. The sub-array 14 includes a metal ground plane 40 spaced about 1" from the substrate 12 to define a resonating cavity therebetween, where a 0.25" thick air gap 42 is provided directly below the substrate 12 and a 0.75" thick foamed ferrite dielectric layer 44 is provided between the air gap 42 and the ground plane 40. The sub-array 14 also includes a 2.1" cm thick lexan dielectric layer 46 that has a dielectric constant of 2.7 and is on top of the substrate 12.

The sub-array 16 includes a metal ground plane 50 spaced about 1.4" from the substrate 12 to define a resonating cavity therebetween that includes an air gap 52. The sub-array 16 also includes two top dielectric layers, specifically a 0.8" thick lexan dielectric layer 54 having a dielectric constant of 2.7 provided directly on top of the substrate 12 and a 0.75" thick foam dielectric layer 56 provided on top of the dielectric layer 54 having a dielectric constant of 1.4.

The sub-array 18 includes a metal ground plane 60 spaced about 0.374" from the substrate 12 to define a resonating cavity therebetween, where a 0.2" thick foam dielectric layer 62 is provided in contact with the substrate 12 that has a dielectric constant of 1.2 and a 35 dB/in carbon loaded honeycomb core dielectric layer 64 is provided between the ground plane 60 and the layer 62. The sub-array 18 also includes a 0.1" thick dielectric layer 66 provided on the substrate 12 that has a dielectric constant of 4.5 and a 0.16" thick foam dielectric layer 68 is provided on the dielectric layer 66 that has a dielectric constant of 1.98.

Figure 4:
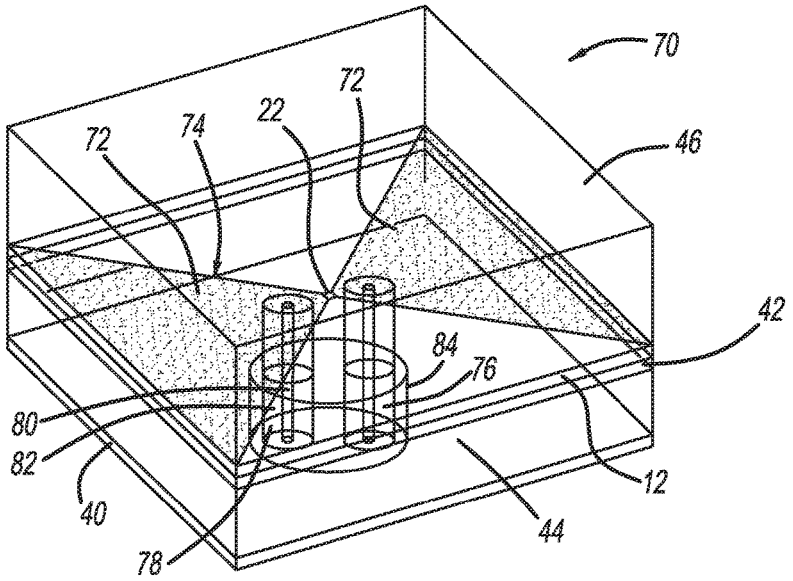
FIG. 4 is an isometric line-drawing of a single unit cell for a high-band sub-array in the phased array.

FIG. 4 is an isometric line-drawing of one unit cell 70 of the sub-array 14 depicting how the radiating elements 20 are fed in one non-limiting embodiment, where like elements to FIGS. 1 and 3 have the same reference number. The sub-array 14 includes a matrix of the unit cells 70 provided in the configuration as discussed herein. The unit cell 70 includes two triangular radiating portions 72, where each portion 72 is half of a radiating element 20, and where the two triangular portions 72 define a bowtie radiator 74. The electrical feed system includes a pair of coaxial cables 76 and 78 each including an inner conductor 80 and an outer conductor 82 that are provided in a common insulator 84 and extend across the resonating cavity, where the inner conductors 80 are electrically coupled to separate ones of the triangular portions 72 proximate the feed point 22 and the outer conductors 82 are electrically coupled to the ground plane 40. It is noted that using the coaxial cables 76 and 78 as the feed is by way of a non-limiting example in that other feed systems may be applicable, such as a dual-polarized balun.

Figure 5:
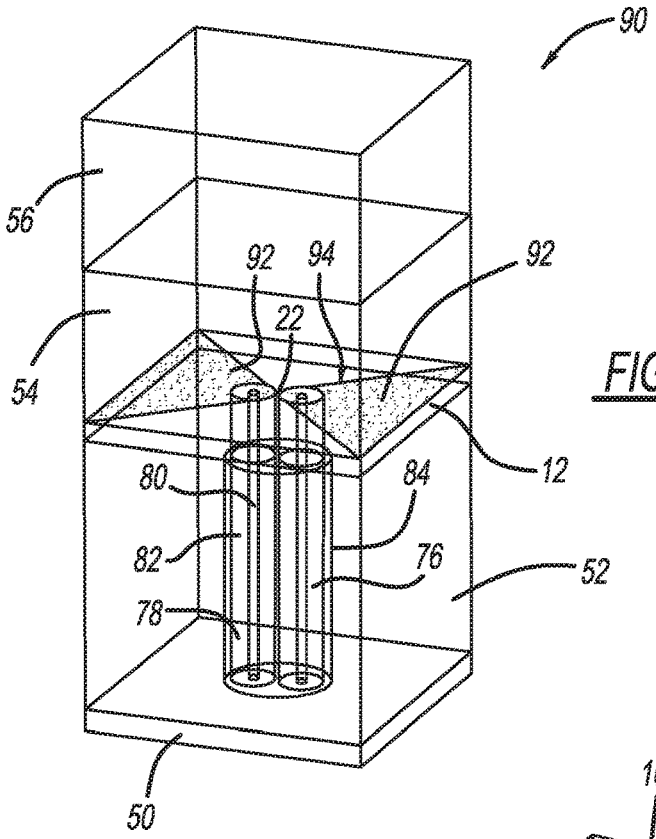
FIG. 5 is an isometric line-drawing of a single unit cell for a mid-band sub-array in the phased array.

FIG. 5 is an isometric line-drawing of a unit cell 90 for the sub-array 16 depicting how the radiating elements 20 are fed in one non-limiting embodiment, where like elements to FIGS. 1, 3 and 4 have the same reference number. The sub-array 16 will include a matrix of the unit cells 90 provided in the configuration as discussed herein. The unit cell 90 includes two triangular portions 92, where each portion 92 is half of a radiating element 20, and where the two triangular portions 92 define a bowtie radiator 94.

Figure 6:
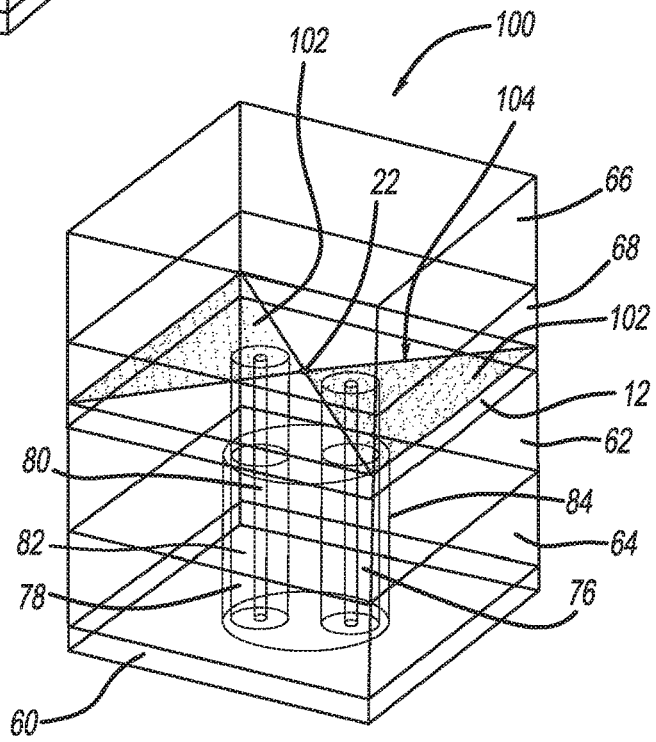
FIG. 6 is an isometric line-drawing of a single unit cell for a low-band sub-array in the phased array.

FIG. 6 is an isometric line-drawing of a unit cell 100 of the sub-array 18 depicting how the radiating elements 20 are fed in one non-limiting embodiment, where like elements to FIGS. 1, 3 and 4 have the same reference number. The sub-array 18 will include a matrix of the unit cells 100 provided in the configuration as discussed herein. The unit cell 100 includes two triangular portions 102, where each portion 102 is half of a radiating element 20, and where the two triangular portions 102 define a bowtie radiator 104.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A phased array comprising:

a high-band sub-array including a plurality of electrically coupled high-band radiating elements formed on a substrate, a high-band ground plane spaced from the substrate, at least one high-band dielectric layer provided between the substrate and the high-band ground plane, and at least one dielectric layer provided on the substrate opposite to the high-band ground plane;

a mid-band sub-array surrounding the high-band sub-array, said mid-band sub-array including a plurality of electrically coupled mid-band radiating elements formed on the substrate, a mid-band ground plane spaced from the substrate, at least one dielectric layer provided between the mid-band ground plane and the substrate, and at least one dielectric layer provided on the substrate opposite to the mid-band ground plane; and a low-band sub-array surrounding the mid-band sub-array, said low-band sub-array including a plurality of electrically coupled low-band radiating elements formed on the substrate, a low-band ground plane spaced from the substrate, at least one dielectric layer provided between the substrate and the low-band ground plane, and at least one dielectric layer provided on the substrate opposite to the low-band ground plane.

2. The phased array according to claim 1 wherein the at least one dielectric layer provided between the substrate and the high-band ground plane includes a first foam dielectric layer having a thickness of about 0.2" positioned adjacent to the substrate and a 35 dB/in carbon loaded honeycomb core layer having a thickness of about 0.2" positioned between the first foam layer and the high-band ground plane, and the at least one dielectric layer provided on the substrate in the high-band sub-array includes a second foam dielectric layer having a thickness of about 0.1" and a dielectric constant of 4.5 positioned on the substrate and a third foam dielectric layer having a thickness of about 0.16" and a dielectric constant of 1.98 positioned on the foam layer.

3. The phased array according to claim 1 wherein the at least one dielectric layer provided between the substrate and the mid-band ground plane includes an air layer having a thickness of about 1.4", and the at least one dielectric layer provided on the substrate in the mid-band sub-array includes a lexan layer having a thickness of about 0.8" and a dielectric constant of 2.7 positioned on the substrate and a foam layer having a thickness of about 0.75" and a dielectric constant of 1.4 positioned on the lexan layer.

4. The phased array according to claim 1 wherein the at least one dielectric layer provided between the substrate and the low-band ground plane includes an air layer provided adjacent to the substrate and foamed ferrite layer having a thickness of about 0.75" positioned between the air layer and the ground plane, and the at least one dielectric layer provided on the substrate in the low-band sub-array includes a 2.1" thick lexan layer having a dielectric constant of 2.7.

5. The phased array according to claim 1 wherein the high-band is a 3-18 GHz frequency band, the mid-band is a 500 MHz-3 GHz frequency band and the low-band is a 100-500 MHz frequency band.

6. The phased array according to claim 1 wherein the high-band sub-array has a thickness of about 0.636", the mid-band sub-array has a thickness of about 2.95", and the low-band sub-array has a thickness of about 3".

7. The phased array according to claim 1 wherein all of the high-band sub-array, the mid-band sub-array and the low-band sub-array are square arrays having a common square aperture.

8. The phased array according to claim 1 wherein all of the radiating elements are square radiating element where adjacent square radiating elements are electrically coupled at element points, and where each electrically coupled radiating element is fed at locations where the points contact each other.

9. The phased array according to claim 8 wherein each square radiating element includes two triangularly-shaped radiating portions, and wherein electrically coupled radiating portions of adjacent radiating elements define a bowtie radiator.

10. The phased array according to claim 8 wherein the radiating elements are fed by a coaxial feed line.

11. The phased array according to claim 1 wherein some adjacent radiating elements in the mid-band sub-array and the high-band sub-array are electrically coupled to each other and some radiating elements in the mid-band sub-array and the low-band sub-array are electrically coupled to each other.

12. A phased array comprising a plurality of nested sub-arrays where the sub-arrays are nested in that at least one inner sub-array is surrounded by at least one outer sub-array, and where each sub-array includes a plurality of bowtie radiators each being defined by opposing triangular-shaped radiating portions and where each bowtie radiator in each sub-array has a same size, each bowtie radiator in one sub-array has a different size than the bowtie radiators in the other sub-arrays and each sub-array operates at a different frequency band than the other sub-arrays, and where the plurality of nested sub-arrays have a common aperture, wherein the plurality of bowtie radiators are defined by a configuration of a plurality of square radiating elements, and wherein each square radiating element is formed by two of the triangularly-shaped radiating portions, and wherein electrically coupled triangularly-shaped radiating portions of adjacent radiating elements define a single bowtie radiator, and where each bowtie radiator is fed at a point where the two radiating portions contact each other, wherein some adjacent radiating elements in one of the sub-arrays are electrically coupled to radiating elements in an adjacent sub-array.

13. The phased array according to claim 12 wherein the radiating elements are fed by a coaxial feed line.

14. The phased array according to claim 12 wherein the plurality of nested sub-arrays is three nested sub-arrays.

15. The phased array according to claim 12 wherein each of the plurality of nested sub-arrays is a square sub-array.

16. A phased array comprising: a square high-band sub-array including a plurality of electrically coupled square high-band radiating elements formed on a substrate, a high-band ground plane spaced from the substrate, at least one high-band dielectric layer provided between the substrate and, the high-band ground plane, and at least one dielectric layer provided on the substrate opposite to the high-band ground plane; a square mid-band sub-array surrounding the high-band sub-array, said mid-band sub-array including a plurality of electrically coupled square mid-band radiating elements formed on the substrate, a mid-band ground plane spaced from the substrate, at least one dielectric layer provided between the mid-band ground plane and the substrate, and at least one dielectric layer provided on the substrate opposite to the mid-band ground plane; and a square low-band sub-array surrounding the mid-band sub-array, said low-band sub-array including a plurality of electrically coupled square low-band radiating elements formed on the substrate, a low-band ground plane spaced from the substrate, at least one dielectric layer provided between the substrate and the low-band ground plane, and at least one dielectric layer provided on the substrate opposite to the low-band ground plane, wherein the high-band sub-array, the mid-band sub-array and the low-band sub-array have a common aperture, and wherein adjacent square radiating elements are electrically coupled at element points in each sub-array, and wherein each square radiating element, includes two triangularly-shaped radiating portions, and wherein electrically coupled radiating portions of adjacent radiating elements define a bowtie radiator, and electrically coupled radiating elements are fed at locations where the points contact each other.

17. The phased array according to claim 16 wherein the high-band is a 3-18 GHz frequency band, the mid-band is a 500 MHz-3 GHz frequency band and the low-band is a 100-500 MHz frequency band.

18. The phased array according to claim 16 wherein the high-band sub-array has a thickness of about 0.636", the mid-band sub-array has a thickness of about 2.95", and the low-band sub-array has a thickness of about 3".

* * * * *